US009605841B2

(12) United States Patent
Chou

(10) Patent No.: US 9,605,841 B2
(45) Date of Patent: Mar. 28, 2017

(54) INTERNAL REFLECTIVE LIGHT FIXTURE

(71) Applicant: Huan-Chiu Chou, Keelung (TW)

(72) Inventor: Huan-Chiu Chou, Keelung (TW)

( * ) Notice: Subject to any disclaimer, the term of this patent is extended or adjusted under 35 U.S.C. 154(b) by 1 day.

(21) Appl. No.: 14/676,650

(22) Filed: Apr. 1, 2015

(65) Prior Publication Data

US 2016/0061433 A1 Mar. 3, 2016

(30) Foreign Application Priority Data

Sep. 2, 2014 (TW) ..... 103130176 A

(51) Int. Cl.

| | |
|---|---|
| ***F21V 7/00*** | (2006.01) |
| ***F21V 29/70*** | (2015.01) |
| ***F21V 29/00*** | (2015.01) |
| ***F21V 29/15*** | (2015.01) |
| ***F21V 23/00*** | (2015.01) |
| ***F21K 9/23*** | (2016.01) |
| *F21Y 101/00* | (2016.01) |
| *F21Y 103/33* | (2016.01) |

(52) U.S. Cl.

CPC ..... *F21V 29/70* (2015.01); *F21K 9/23* (2016.08); *F21V 7/0008* (2013.01); *F21V 7/0033* (2013.01); *F21V 7/0091* (2013.01); *F21V 23/003* (2013.01); *F21V 29/004* (2013.01); *F21V 29/15* (2015.01); *F21Y 2101/00* (2013.01); *F21Y 2103/33* (2016.08)

(58) Field of Classification Search

CPC .... F21V 7/0033; F21V 7/0083; F21V 7/0008; F21Y 2103/022

See application file for complete search history.

(56) References Cited

U.S. PATENT DOCUMENTS

| | | | | |
|---|---|---|---|---|
| 3,732,415 A * | 5/1973 | Lindae | F21S 48/1113 | 174/17.05 |
| 4,037,096 A * | 7/1977 | Brendgord | F21V 7/0008 | 362/294 |
| 5,097,401 A * | 3/1992 | Eppler | F21V 7/0008 | 362/223 |
| 5,929,788 A * | 7/1999 | Vukosic | B60Q 1/2611 | 340/471 |
| 7,121,691 B2 * | 10/2006 | Coushaine | F21S 48/328 | 362/298 |

(Continued)

*Primary Examiner* — Julie Bannan

(74) *Attorney, Agent, or Firm* — Ming Chow; Sinorica, LLC

(57) ABSTRACT

The present invention is an internal reflective light fixture, comprising a luminescence unit, a reflection member and a cup body. The luminescence unit comprises a light-holding part for emitting a light ray. The reflection member comprises a securing part and a reflection part, wherein the reflection part is formed at one side of the securing part and forms a reflective curved surface with a first reflective layer. The cup body contains the luminescence unit and the reflection member. The cup body comprises a second reflective layer formed on the interior wall of the cup body, a first containing space and a securing trough. The securing trough is provided to fix the securing part so that the reflection part is exposed at the first containing space. The light ray is reflected to the second reflective layer by the first reflective layer and then emitted from the cup body.

20 Claims, 8 Drawing Sheets

(56) References Cited

U.S. PATENT DOCUMENTS

| | | | | |
|---|---|---|---|---|
| 8,303,139 | B1 * | 11/2012 | Ohm | F21S 8/06 362/298 |
| 2005/0024870 | A1 * | 2/2005 | Coushaine | F21K 9/00 362/249.02 |
| 2009/0296387 | A1 * | 12/2009 | Reisenauer | F21K 9/135 362/235 |
| 2010/0254128 | A1 * | 10/2010 | Pickard | F21V 7/0033 362/231 |
| 2010/0301353 | A1 * | 12/2010 | Pabst | F21V 7/0008 257/88 |
| 2013/0170221 | A1 * | 7/2013 | Isogai | F21K 9/13 362/300 |

* cited by examiner

INTERNAL REFLECTIVE LIGHT FIXTURE

The current application claims a foreign priority to application number 103130176 filed on Sep. 2, 2014 in Taiwan.

FIELD OF THE INVENTION

The present invention is related to the art of illumination, more specifically, to an internal reflective light fixture with great efficiency of heat dissipation and light emitting.

BACKGROUND OF THE INVENTION

A conventional light fixture disposes a luminescence source at its central part. Although such configuration may output the light generated from the luminescence source directly, it is difficult to adjust the emitting angle and the emitting shape of the light fixture. Additionally, the observable luminescence source affects the appearance of the light fixture then.

Therefore, the light fixture further fixes the luminescence source beneath a cooling body to prevent users from directly observing the luminescence source; however, to avoid accumulating heat from the luminescence source, the heat is dissipated by a thermal conduit. Nevertheless, such configuration is limited by the capability and distance of the conduction, which results in serious light attenuation of the luminescence source.

With the demand of energy saving, bulbs utilized by a conventional light fixture are gradually replaced by light-emitting diodes. Adopting light-emitting diodes may acquire the advantages such as energy-saving and reliability-extending, but in fact, light-emitting diodes still possess the disadvantages such as finite optical intensity and generation of waste heat.

To improve the aforementioned drawbacks, a conventional light fixture resolves the issue of optical intensity by modifying the light fixture. Meanwhile, such a light fixture combines a cooling structure to enhance the efficiency of heat dissipation.

Although the cooling structure may enhance the efficiency of heat dissipation, it generally occupies a comparatively large volume, which is unfavorable to dispose the luminescence source at the center of a conventional light fixture.

On the other hand, the central part of a light-emitting diode usually provides the highest optical intensity, which is decreased with the increase of the emitting angle. Therefore, prior arts utilize a light-emitting diode with high power and wide emitting angle or a plurality of light-emitting diodes to enhance the entire optical intensity of the luminescence source.

However, a light-emitting diode with high power possesses a disadvantage of hyperpyrexia generation, which is a major cause for reducing the reliability of the luminescence source.

Inasmuch as aforementioned, an internal reflective light fixture is disclosed in the present invention to resolve the drawbacks of the prior arts.

SUMMARY OF THE INVENTION

A first objective of the present invention is to provide an internal reflective light fixture, comprising a luminescence unit, a reflection member and a cup body. The reflection member has a reflective curved surface which is capable of rapidly conducting the heat generated from the luminescence unit to the cup body for heat dissipation besides reflecting the light rays generated from the luminescence unit and adjusting the emitting angle of the light rays as well as.

A second objective of the present invention is to provide the aforementioned internal reflective light fixture, wherein an inner space of the reflective curved surface can be used to contain a driving circuit to drive the luminescence unit.

A third objective of the present invention is to provide the aforementioned internal reflective light fixture, wherein the light rays generated from the luminescence unit emits towards the reflection member so that the luminescence unit is prevented from being observable from the outside of the internal reflective light fixture besides avoiding the light rays directly emitting from the internal reflective light fixture, wherein the light rays is generated from a plurality of luminescence devices or an annular COB.

The forth objective of the present invention is to provide the aforementioned internal reflective light fixture, wherein the reflection member completely reflects the light rays generated from the luminescence unit by a first reflective layer on the reflective curved surface.

The fifth objective of the present invention is to provide the aforementioned internal reflective light fixture, wherein the cup body further comprises a second reflective layer and a securing trough, and the second reflective layer further reflects the light rays from the reflective curved surface.

The sixth objective of the present invention is to provide the aforementioned internal reflective light fixture, wherein the geometry of the cup body is capable of adjusting the emitting angle and emitting shape of the output light rays.

The seventh objective of the present invention is to provide the aforementioned internal reflective light fixture, wherein the interior wall and/or the exterior wall are coated by a radiating lacquer in order to enhance the efficacy of the heat dissipation.

The eighth objective of the present invention is to provide the aforementioned internal reflective light fixture, wherein the securing trough is capable of containing the reflection member and a driving circuit to fit the internal reflective light fixture to a conventional lamp socket.

The ninth objective of the present invention is to provide the aforementioned internal reflective light fixture, wherein a thermal-conductive insulating paste is filled into the securing trough to accelerate dissipating the heat from the luminescence unit and the reflection member.

The tenth objective of the present invention is to provide the aforementioned internal reflective light fixture, wherein the thermal-conductive insulating paste may comprises at least an additive (aluminum nitride for example) for achievement of enhancing the efficacies of thermal conduction and insulation.

The eleventh objective of the present invention is to provide the aforementioned internal reflective light fixture, which comprises a cooling shading member that shades the luminescence unit outside the cup body as well as accelerates the heat dissipation from the luminescence unit and the reflection member.

The twelfth objective of the present invention is to provide the aforementioned internal reflective light fixture, which comprises an insulating cooling sheet disposed between the luminescence unit and the reflection member to achieve the efficacies of thermal conduction and insulation.

The thirteenth objective of the present invention is to provide the aforementioned internal reflective light fixture, wherein the reflection member forms a containing space. Besides containing a driving circuit, the containing space prevents the reflection member from electrically connection to the circuit layout of the luminescence unit.

The fourteenth objective of the present invention is to provide the aforementioned internal reflective light fixture, wherein the material of the cup body may be metal (aluminum for example) or non-metal (plastic for example), and the transparency of the cup body may be transparent or translucent to allow the light rays emitting from the lateral margin beside from the opening of the cup body, wherein the interior wall and exterior wall the cup body still formed by a metallic material.

To achieve the aforementioned and other objectives, the present invention is to provide an internal reflective light fixture, comprising a luminescence unit, a reflection member and a cup body. The luminescence unit emits a light ray and comprises a light-holding part and a lighting part. The reflection member combines the lighting part and comprises a securing part and a reflection part. The reflection part is formed at one side of the securing part and forms a reflective curved surface, wherein a first reflective layer is formed over the reflective curved surface. The cup body contains the luminescence unit and the reflection member and further comprises a second reflective layer, a first containing space and a securing trough. The second reflective layer is formed on the interior wall of the cup body. The securing trough is provided to fix the securing part so that the reflection part is exposed at the first containing space, wherein the light ray is reflected from the first reflective layer to the second reflective layer and then emitted from the cup body.

Compared to the prior arts, the present invention provides an internal reflective light fixture, which reflects the light rays generated from a luminescence unit to the interior wall of a cup body by a reflection member. The emitting angle and emitting shape can be adjusted by modifying the configuration of at least one of the cup body and the reflective curved surface of the reflection member.

The internal reflective light fixture achieves the efficacy of rapidly dissipating the heat generated from the inside of the light fixture by selecting the material of the cup body, coating the radiating lacquer on the cup body, disposing an insulating cooling member to the luminescence unit and filling the thermal-conductive insulating paste within the cup body etc.

The internal reflective light fixture may fabricate the cup body by transparent or translucent plastic. By the metallic material formed on the interior wall and the exterior wall of the cup body, the light rays are allowed to emit from the cup body itself besides the emitting point of the internal reflective light fixture.

DETAILED DESCRIPTION OF THE PREFERRED EMBODIMENTS

In order to fully comprehend the objectives, features and efficacy of the present invention, a detailed description is described by the following substantial embodiments in conjunction with the accompanying drawings. The description is as below.

Figure 1:
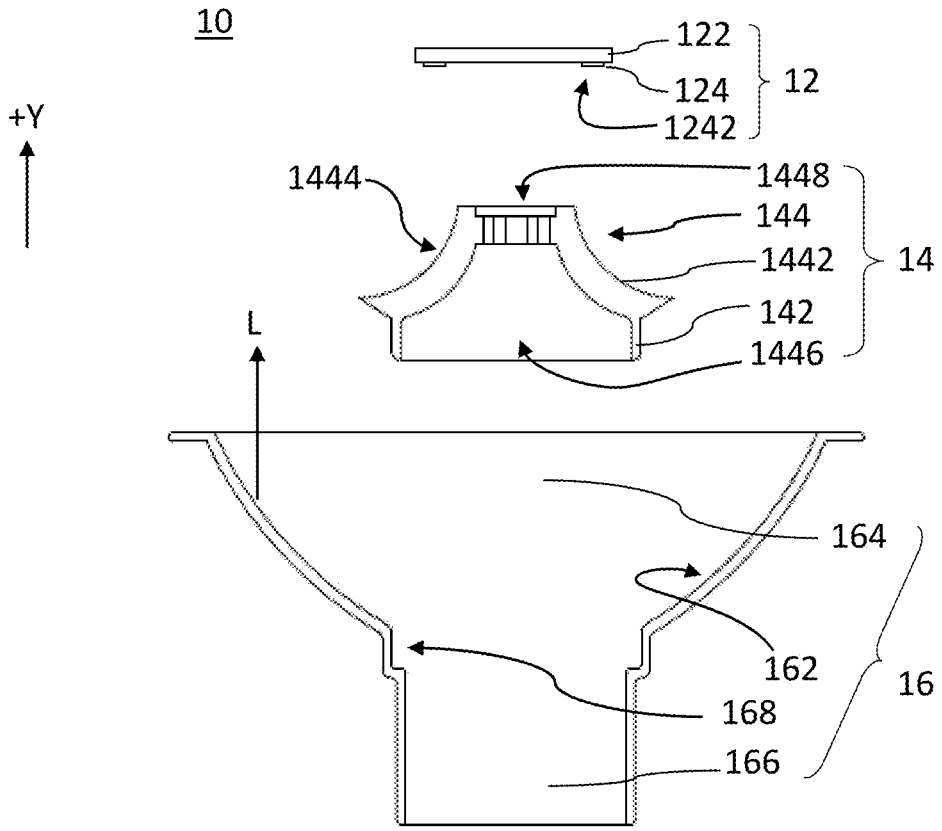
FIG. 1 is a schematic cross-sectional view of an internal reflective light fixture in a first embodiment of the present invention.

Refer to FIG. 1, which is a schematic cross-sectional view of an internal reflective light fixture in a first embodiment of the present invention. In FIG. 1, the internal reflective light fixture 10 comprises a luminescence unit 12, a reflection member 14 and a cup body 16; further, the internal reflective light fixture is exemplified by PAR30.

Figure 2:
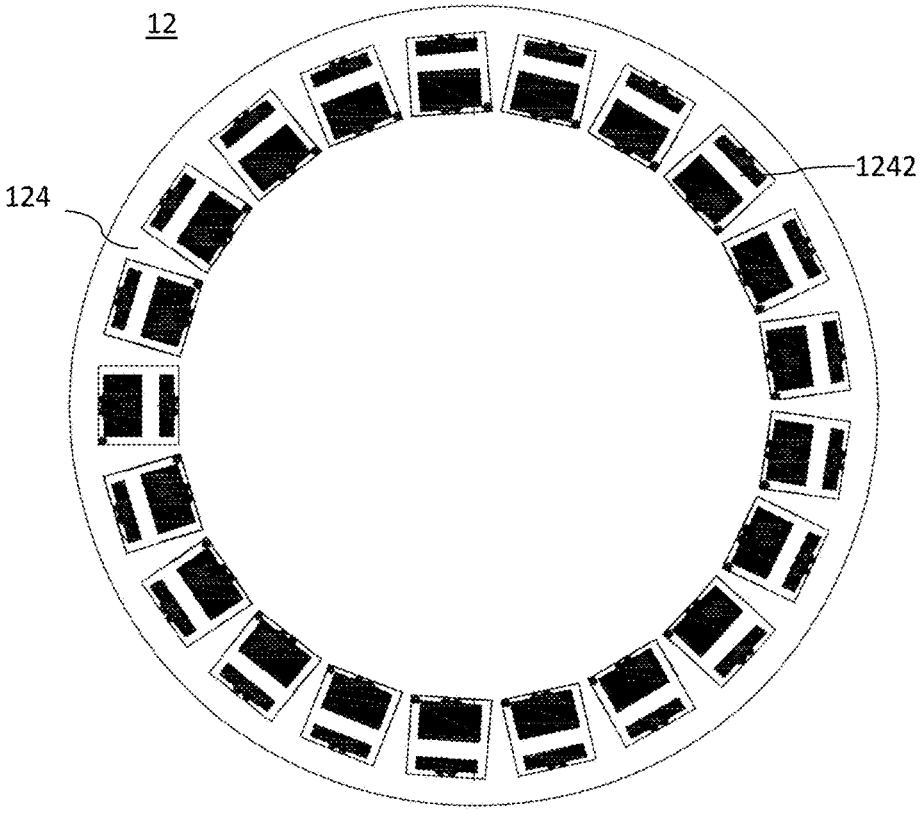
FIG. 2 illustrates the front view of the luminescence unit in FIG. 1 of the present invention.

The luminescence unit 12 comprises a light-holding part 122 and a lighting part 124 with reference to FIG. 2 together. The luminescence unit 12 generates a light ray L.

The light-holding part 122 reveals a first containing space 164 of the cup body 16. The light-holding part 122 dissipates the heat generated from the luminescence unit 12 by the open-ended first containing space 164.

In FIG. 2, the lighting part 124 disposes a plurality of luminescence devices 1242, which may be an epitaxial light-emitting diode, a COB-type light-emitting diode or an annular luminescence device for example.

Back to FIG. 1, the reflection member 14 comprises a securing part 142 and a reflection part 144 and combines the lighting part 124. The reflection part 144 is formed at one side of the securing part 142 and forms a reflective curved surface 1442. The reflection part 144 may be a body with cone-like shape or arbitrary geometry. In addition, a first reflective layer 1444 is formed over the reflective curved surface 1442.

In this embodiment, a second containing space 1446 is further formed in the inside of the reflective curved surface 1442 to support the luminescence unit 12 or contain a driving circuit (not shown). It is worthy to note that, meanwhile, the second containing space 1446 is able to rapidly conduct the heat generated from the luminescence unit 12 to the cup body 16.

Furthermore, the upper margin of the reflective curved surface 1442 may further form a containing trough 1448 to keep the reflection member 144 from electrically connection with the luminescence unit 12.

Back to FIG. 1, the light ray L generated from the plurality of luminescence devices 1242 is emitted to the reflective curved surface 1442, and is reflected to the interior wall of the cup body 16 by the first reflection layer 1444 of the reflective curved surface 1442. The light ray L is then emitted towards +Y direction.

The cup body 16 comprises a second reflective layer 162, the first containing space 164 and a securing trough 166. The material of the cup body 16 may be metal (aluminum for example) or non-metal (thermal-conductive plastic for example). If the cup body 16 is made by the metallic material, the heat generated from the internal reflective light fixture 10 is able to be dissipated by the metal; if the cup body 16 is made by non-metallic material with the feature of thermal conduction, the heat generated from the internal reflective light fixture 10 is able to be dissipated by the non-metallic material by the same token.

The second reflective layer 162 can be formed on the interior wall or exterior wall of the cup body 16 by a method such as sputtering, wherein the second reflective layer 162 provides a high reflection coefficient so that the light ray L is reflected under the condition of low loss. In this embodiment, the geometry of the cup body 16 is a cupped shape which is a curved surface. By designing the curvature of the curved surface, the emitting angle and emitting shape of the emitted light ray L is determined.

The securing trough 166 extends from the first containing space 164. In this embodiment, the securing trough 166 is formed in the bottom of the cup body 16, and its junction with the cup body 16 forms a clip structure 168. As the securing part 142 is advancing towards the clip structure 168, the securing part 142 is fixed to the clip structure 168. It is worthy to note that the clip structure 168 is not an essential structure.

The light ray L is reflected from the first reflective layer 1444 to the second reflective layer 162 and emitted from the cup body 16.

The configuration of the present invention allows the light ray L to be completely reflected by the reflective layers 1444 and 162. Therefore, a light-emitting diode with any power may be utilized as a luminescence source for the luminescence unit 12. In other words, the luminescence source may simply use any type of light-emitting diodes.

In another embodiment, a radiating lacquer is formed on the interior wall and/or the exterior wall of the cup body 16 in order to accelerate the dissipation of the heat generated from the internal reflective light fixture 10.

Figure 3:
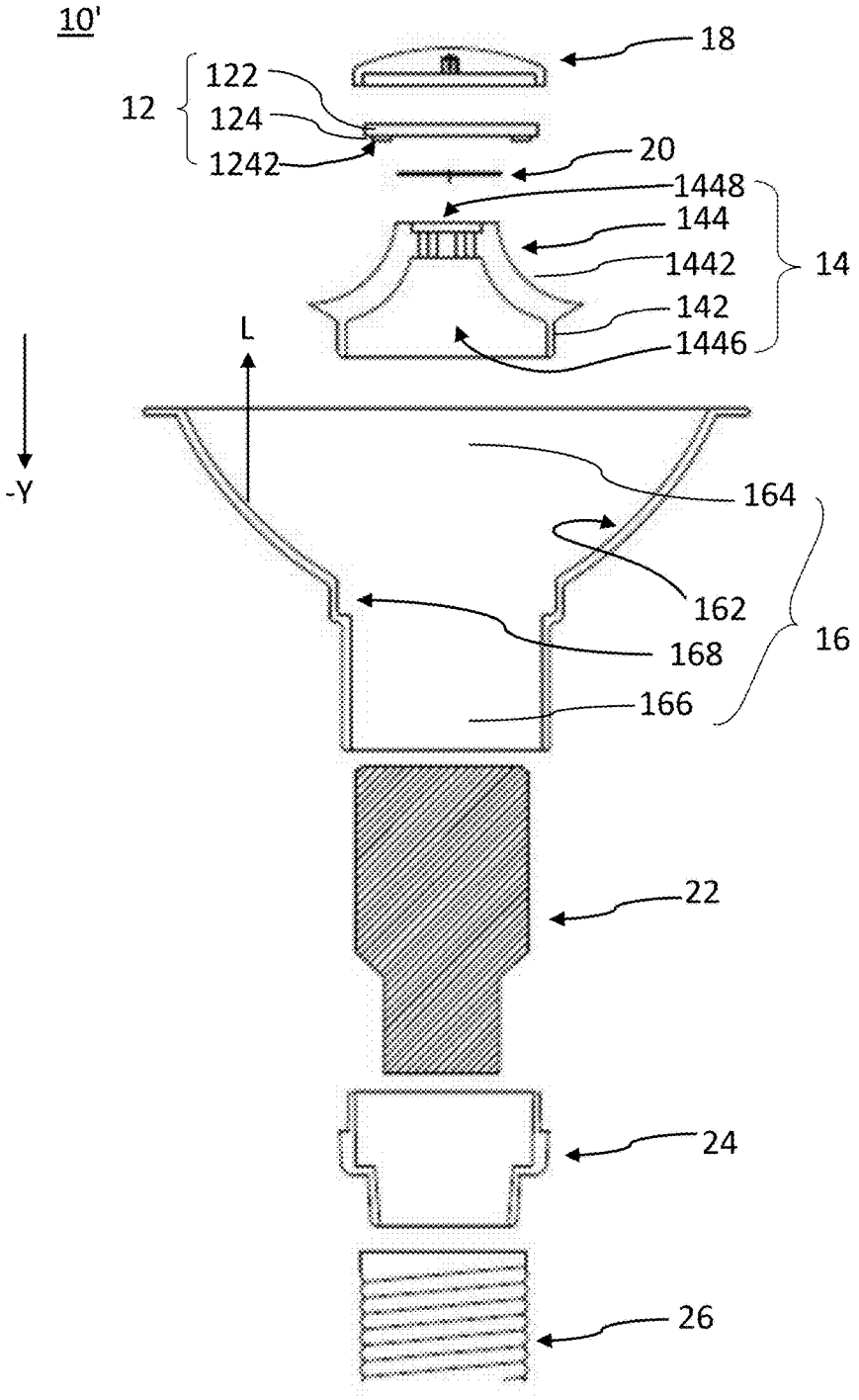
FIG. 3 is a schematic cross-sectional view of an internal reflective light fixture in a second embodiment of the present invention.

Refer to FIG. 3, which is the schematic cross-sectional view of an internal reflective light fixture in a second embodiment of the present invention. In FIG. 3, the internal reflective light fixture 10 further comprises a cooling shading member 18, an insulating cooling member 20, a driving circuit 22, a linking member 24 and a burner 26 besides the luminescence unit 12, the reflection member 14 and the cup body 16 in the first embodiment.

The description and the functions of the luminescence unit 12, the reflection member 14 and the cup body 16 are the same as those illustrated in the first embodiment.

The cooling shading member 18 is disposed at the light-holding part 122 of the luminescence unit 12. The cooling shading member 18 dissipates the heat generated from the luminescence unit 12 or from the inputting of the light ray L on the reflective curved surface 1442. In this embodiment, the size of the cooling shading member 18 allows to shade the luminescence unit 12 so that the luminescence unit 12 is not directly observable while a user observes towards −Y direction. Furthermore, the cooling shading member 18 is able to accelerate the dissipation of the heat with its large area. In another embodiment, the cooling shading member 18 may not be limited to a single one but a plurality by, for example, stacking those cooling shading members 18 to increase the area for heat dissipation.

The insulating cooling member 20 is disposed between the luminescence unit 12 and the reflection member 14 in order to cut off the electrical signal between the luminescence unit 12 and the reflection member 14. Meanwhile, the disposition of the insulating cooling member 20 may have the heat mutually conducted between the luminescence unit 12 and the reflection member 14 for dissipation.

The driving circuit 22 is contained in the securing trough 166 and generates an electrical power to drive the luminescence unit 12. It is worthy to note that, in this embodiment, the driving circuit 22 is disposed at the securing trough 166, while in another embodiment, the driving circuit 22 may be disposed in the outside of the internal reflective light fixture 10' or apart from the internal reflective light fixture 10'.

The linking member 24 is disposed at one side of the securing trough 16 to combine the cup body 16. The linking member 24 may fix the driving circuit 22 to the inside of the securing trough 166 as well.

The burner 26 combines the cup body 16 by the linking member 24 and provided for a connection to a lamp socket (not shown).

Figure 4:
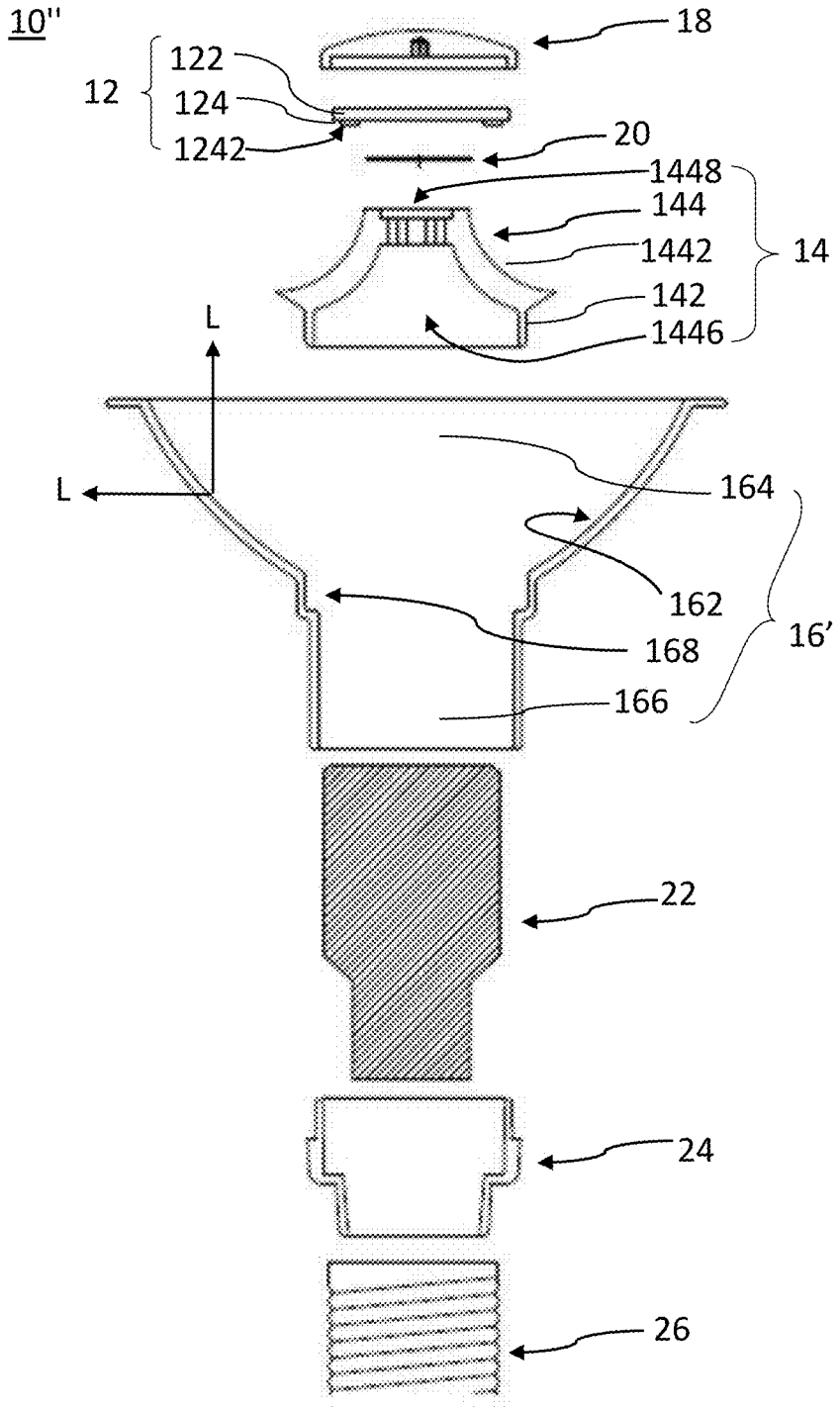
FIG. 4 is a schematic cross-sectional view of an internal reflective light fixture in a third embodiment of the present invention.

Refer to FIG. 4, which is a schematic cross-sectional view of an internal reflective light fixture in a third embodiment of the present invention. In FIG. 4, the inner reflective light fixture 10" comprises the same components as those in the second embodiment, the luminescence unit 12, the reflection member 14, the cooling shading member 18, the insulating cooling member 20, the driving circuit 22, the linking member 24 and the burner 26 but is different from the second embodiment by a cup body 16'.

The material of the cup body 16' is translucent plastic. The interior wall and the exterior wall of the cup body 16' are coated by a metallic material, which may form a second reflective layer 162. In this embodiment, the light ray L is reflected to the second reflective layer 162 from the first reflective layer 1444 and emitted from the cup body 16'. Besides, a portion of the optical energy of the light ray L further penetrates through the lateral margin of the cup body 16 so that the light ray L is emitted from the front margin or lateral margin of the entire internal reflective light fixture 10".

Figure 5:
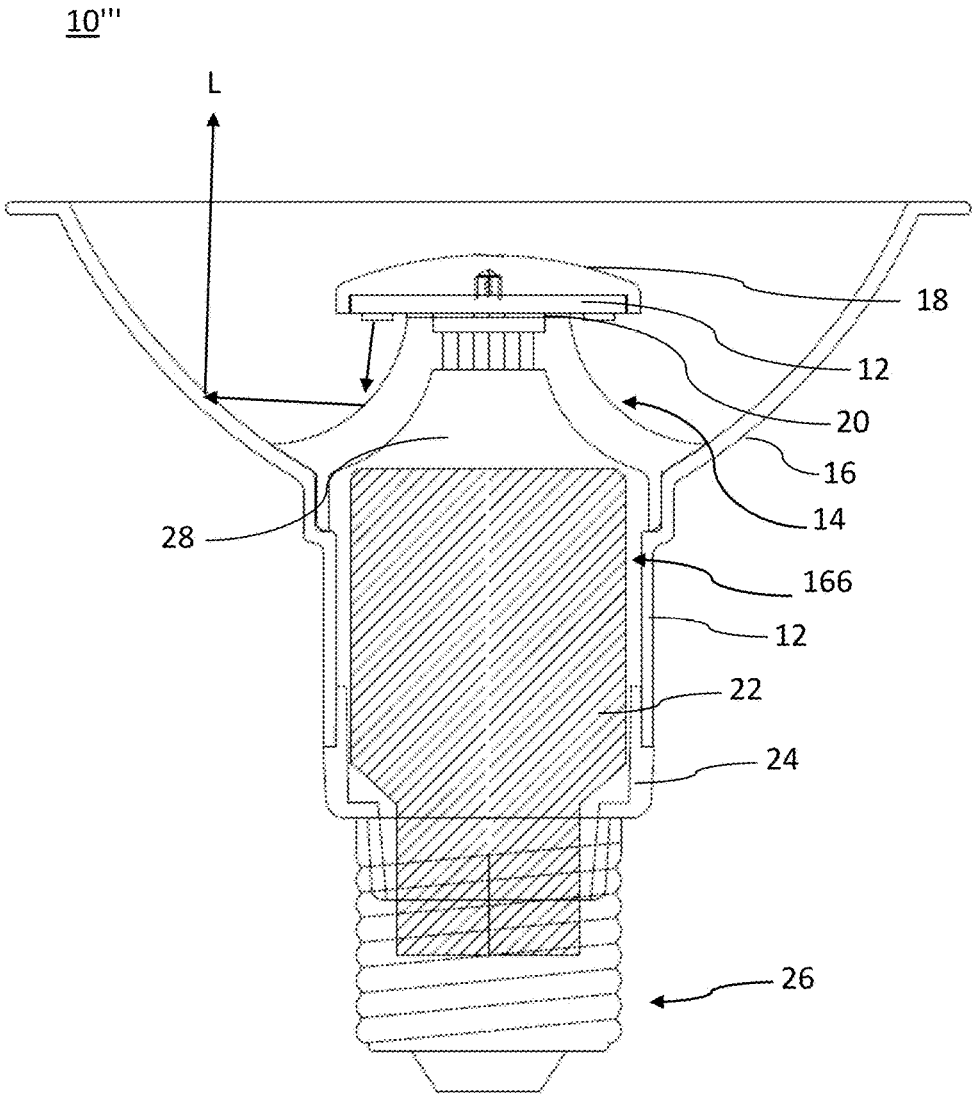
FIG. 5 is a schematic cross-sectional view of a combined internal reflective light fixture in a fourth embodiment of the present invention.

Refer to FIG. 5, which is a schematic cross-sectional view of a combined internal reflective light fixture in a fourth embodiment of the present invention. In FIG. 5, the internal reflective light fixture 10"' further comprises a thermal-conductive insulating paste 28 besides the luminescence unit 12, the reflection member 14, the cup body 16', the cooling shading member 18, the insulating cooling member 20, the driving circuit 22, the linking member 24 and the burner 26 in the second embodiment.

The thermal-conductive insulating paste 28 may be filled into the securing trough 166. Since some voids may still exist as the driving circuit 22 is disposed at the securing trough 166, the thermal-conductive insulating paste 28 is used to fill the voids so that the internal reflective light fixture 10" may rapidly conduct heat to the outside of the cup body 16' by the thermal-conductive insulating paste 28. Furthermore, the thermal-conductive insulating paste 28 can prevent the danger of electrical shock caused by the electricity with its feature of electrical insulation.

In another embodiment, a highly conductive insulating material such as aluminum nitride may be further added into the thermal-conductive insulating paste 28. Aluminum nitride is a ceramic insulator with a feature of great thermal conduction that accelerates heat dissipation.

Figure 6:
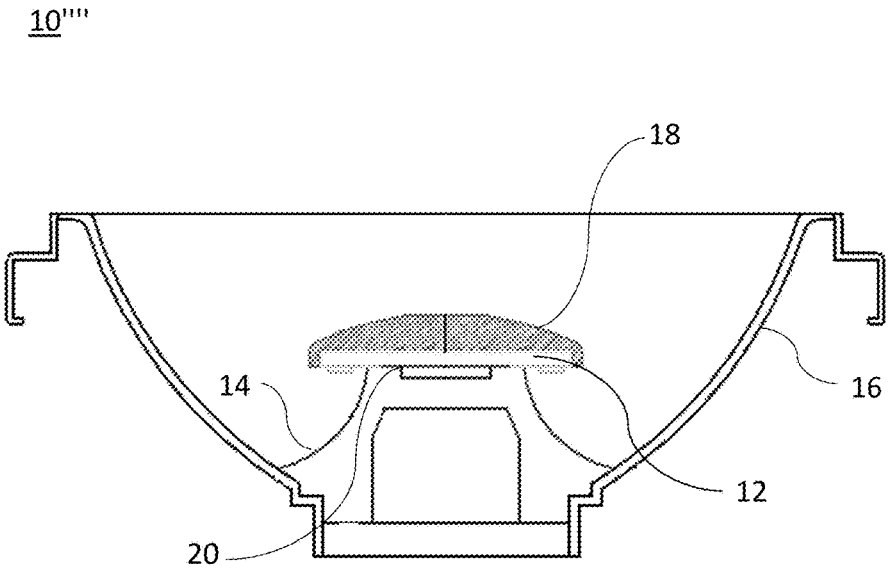
FIG. 6 is a schematic cross-sectional view of an internal reflective light fixture in a fifth embodiment of the present invention.

Refer to FIG. 6, which is a schematic cross-sectional view of an internal reflective light fixture in a fifth embodiment of the present invention. In FIG. 6, the internal reflective light fixture 10"" is exemplified by AR111. The internal reflective light fixture 10"" comprises a luminescence unit 12, a reflection member 14, a cut body 16, a cooling shading member 18 and an insulating cooling member 20. The descriptions of these components are as aforementioned embodiment.

Figure 7:
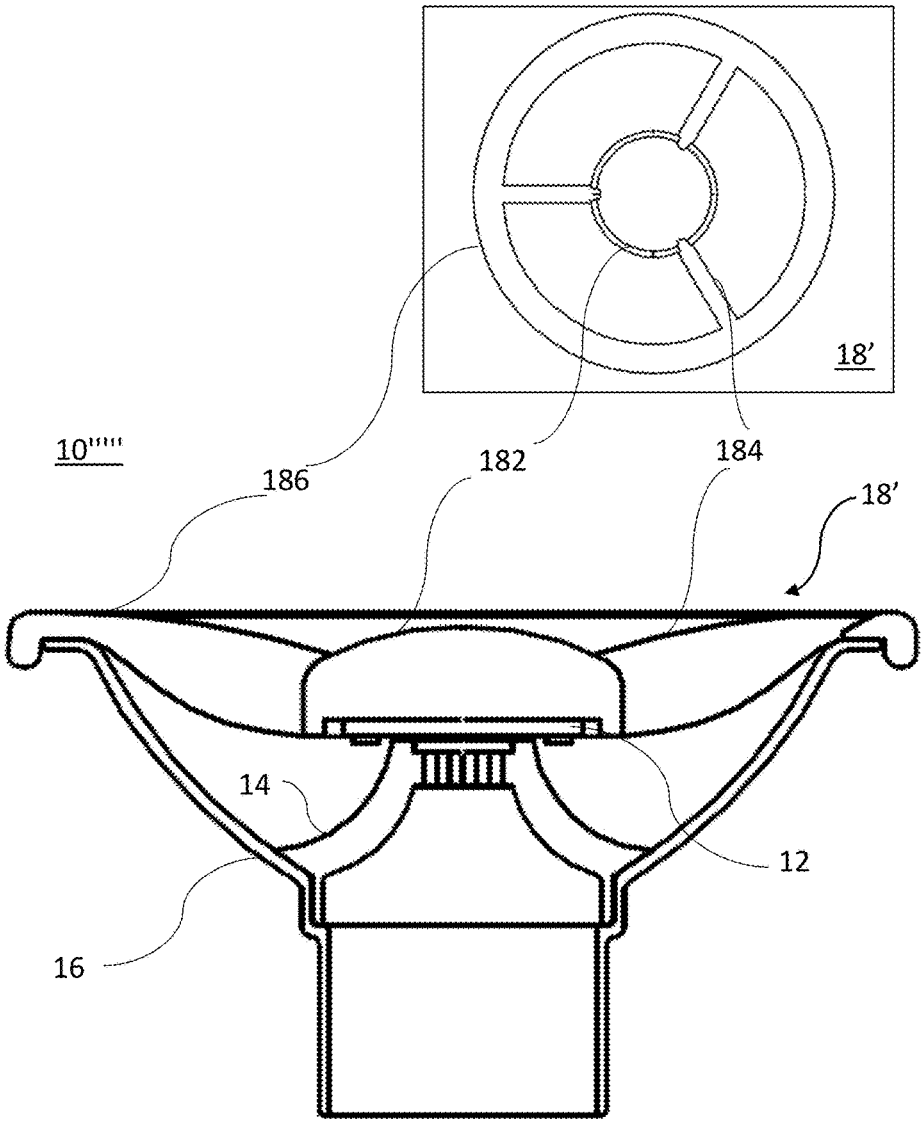
FIG. 7 is a schematic cross-sectional view of an internal reflective light fixture in a sixth embodiment of the present invention.

Refer to FIG. 7, which is a schematic cross-sectional view of an internal reflective light fixture in a sixth embodiment of the present invention. In FIG. 7, the internal reflective light fixture 10"" comprises those mentioned in the fifth embodiment, the luminescence unit 12, the reflection member 14, the cup body 16 and the insulating cooling member 20 but is different from the fifth embodiment by a cooling shading member 18'. The descriptions of the luminescence unit 12, the reflection member 14, the cup body 16 and the insulating cooling member 20 are as aforementioned embodiment.

The cooling shading member 18' comprises a body 182, a plurality of cooling sheets 184 and a cooling annulus 186. The body 182 is disposed above the luminescence unit 12 to provide a shade for the luminescence unit 12 and dissipate the heat generated by the luminescence unit 12. The plurality of cooling sheets 184 extends from the body 182 to the cooling annulus 186, which could be referred in conjunction with the detailed top view of the cooling shading member 18 in the same drawing. The cooling annulus 186 may combine the upper margin of the cup body 16. The plurality of cooling sheets 184 may introduce the heat, which is, for example, accumulated by the cooling shading member 18', to the cooling annulus 186 and further accelerate heat dissipation by the cup body 16. In this embodiment, the quantity of the cooling sheets 184 is exemplified by three. In fact, the quantity of the cooling sheets 184 may be increased or decreased according to the design of the internal reflective light fixture.

In another embodiment, the cooling annulus 186 may be a part of the cup body 16, i.e., the plurality of cooling sheets 184 may extend from the body 182 to the cup body 16.

In another embodiment, the cooling shading member 18' may be made with the cup body 16 as one piece as well.

It is worthy to note that the plurality of cooling sheets 184 has slight influence on the emitting shape with its geometry in the form of thin-slice shape or thin-pole shape.

Figure 8:
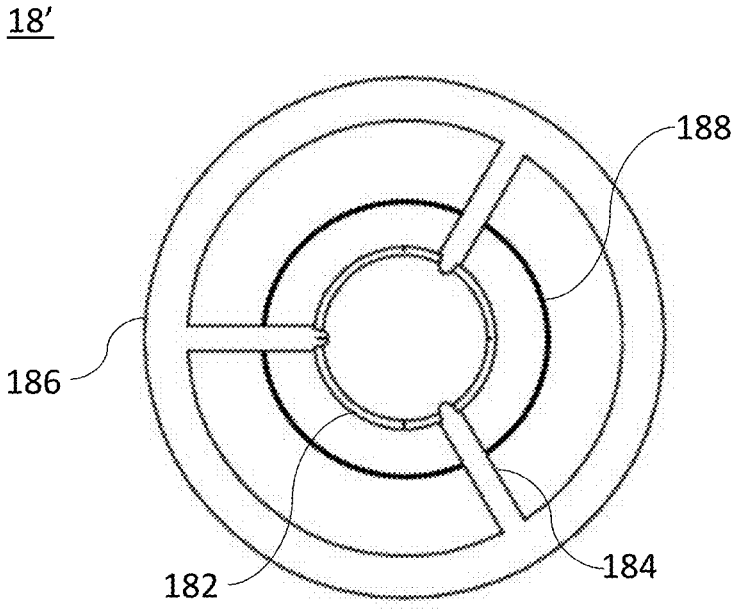
FIG. 8 illustrates the top view of a cooling shading member of another embodiment in FIG. 7 of the present invention.

In another embodiment in conjunction with FIG. 8, the cooling shading member 18' further comprises an annular cooling sheet 188, which is disposed between the plural cooling sheets 184 to enhance the efficacy of heat dissipation. It is worthy to note that the annular cooling sheet 188 is exemplified by a single one in FIG. 8. In fact, the quantity of the annular cooling sheet 188 may be single or plural.

The present invention is disclosed by the preferred embodiment in the aforementioned description; however, it is contemplated for one skilled at the art that the embodiments are applied only for an illustration of the present invention rather than are interpreted as a limitation for the scope of the present invention. It should be noted that the various substantial alternation or replacement equivalent to these embodiments shall be considered as being covered within the scope of the present invention. Therefore, the protection scope of the present invention shall be defined by the claims.

What is claimed is:

1. An internal reflective light fixture comprising:
- a luminescence unit;
- a reflection member;
- a cup body;
- the luminescence unit comprising a light-holding part and a lighting part;
- the lighting part being mounted on the light-holding part;
- the lighting part emitting a light ray;
- the reflection member being combined with the lighting part;
- the reflection member comprising a securing part and a reflection part;
- the reflection part being formed at one side of the securing part;
- the reflection part comprising a reflective curved surface and a first reflective layer;
- the first reflective layer being formed on the reflective curved surface;
- the cup body accommodating the luminescence unit and the reflection member;
- the cup body comprising an exterior wall, an interior wall, a second reflective layer, a first containing space and a securing trough;
- the second reflective layer being formed on the interior wall;
- the securing trough being provided to fix the securing part so that the reflection part is exposed at the first containing space;
- the light ray being emitted from the lighting part to the first reflective layer and being further reflected by the first reflective layer to the second reflective layer; and
- the light ray reflected to the second reflective layer comprising a portion and a remaining portion, the portion being reflected by the second reflective layer, the remaining portion penetrating through the second reflective layer, the interior wall and the exterior wall.

2. The internal reflective light fixture of claim 1 further comprising:
- the lighting part comprising a plurality of luminescence devices; and
- the plurality of luminescence devices being formed by a plurality of epitaxial light-emitting diodes, a plurality of COB-type light-emitting diodes or an annular luminescence component.

3. The internal reflective light fixture of claim 1 further comprising:
- the reflection member being composed by thermal-conductive material;
- the reflection member being provided to dissipate a heat; and
- the heat being generated from the luminescence unit or being generated by emitting the light ray on the reflection part.

4. The internal reflective light fixture of claim 3 further comprising:
- a driving circuit;
- the reflection member further comprising a second containing space; and
- the driving circuit being accommodated in the second containing space.

5. The internal reflective light fixture of claim 1 further comprising:
- a driving circuit;
- the reflection member further comprising a second containing space; and
- the driving circuit being accommodated in the second containing space.

6. The internal reflective light fixture of claim 1 further comprising:
- the reflection part being of a shape that renders the reflective curved surface corresponding to the second reflective layer.

7. The internal reflective light fixture of claim 1 further comprising:

the reflection part further comprising a containing trough; and the containing trough preventing the reflection part from being electrically connected with the luminescence unit.

8. The internal reflective light fixture of claim 1 further comprising:

a cooling shading member;

the cooling shading member being disposed at the light-holding part;

the cooling shading member dissipating a heat; and the heat being generated from the luminescence unit or being generated by emitting the light ray on the reflection part.

9. The internal reflective light fixture of claim 1 further comprising:

an insulating cooling member;

the insulating cooling member being disposed between the reflection member and the luminescence unit;

the insulating cooling member preventing the reflection member from being electrically connected with the luminescence unit;

the insulating cooling member being adapted to introduce a heat generated from the luminescence unit to the reflection member to dissipate; and the insulating cooling member being adapted to introduce another heat generated from the reflection member to the luminescence unit to dissipate.

10. The internal reflective light fixture of claim 7 further comprising:

an insulating cooling member;

the insulating cooling member being disposed between the reflection member and the luminescence unit;

the insulating cooling member preventing the reflection part from being electrically connected with the luminescence unit;

the insulating cooling member being adapted to introduce a heat generated from the luminescence unit to the reflection member to dissipate; and the insulating cooling member being adapted to introduce another heat generated from the reflection member to the luminescence unit to dissipate.

11. The internal reflective light fixture of claim 1 further comprising:

a driving circuit;

the driving circuit being accommodated in the securing trough; an the driving circuit generating an electrical power to drive the luminescence unit.

12. The internal reflective light fixture of claim 1 further comprising:

a thermal-conductive insulating paste, and the thermal-conductive insulating paste being filled in the securing trough.

13. The internal reflective light fixture of claim 1 further comprising:

the cup body further comprising a radiating lacquer; and the radiating lacquer being formed on at least one of the exterior wall and the interior wall.

14. The internal reflective light fixture of claim 8 further comprising:

the cooling shading member comprising a body, a plurality of cooling sheets and a cooling annulus;

the body being disposed above the luminescence unit to shade the luminescence unit and dissipate a heat generated from the luminescence unit; and the plurality of cooling sheets extending from the body to the cooling annulus.

15. The internal reflective light fixture of claim 8 further comprising:

the cooling shading member comprising a body and a plurality of cooling sheets;

the body being disposed above the luminescence unit to shade the luminescence unit and dissipate a heat generated from the luminescence unit; and the plurality of cooling sheets extending from the body to the cup body.

16. An internal reflective light fixture comprising:

a luminescence unit;

a reflection member;

a cup body;

a cooling shading member;

the luminescence unit comprising a light-holding part and a lighting part;

the lighting part being mounted on the light-holding part;

the reflection member comprising a securing part and a reflection part;

the reflection part being formed with the securing part;

the reflection part supporting the light-holding part;

the reflection part comprising a reflective curved surface and a first reflective layer;

the first reflective layer being formed on the reflective curved surface;

the cup body accommodating the luminescence unit and the reflection member;

the cup body comprising an exterior wall, an interior wall, a second reflective layer, a first containing space and a securing trough;

the second reflective layer being formed on the interior wall;

the securing trough being provided to fix the securing part so that the reflection part and the luminescence unit are exposed at the first containing space;

the cooling shading member comprising a central plate, a plurality of elongated sheets, an annular sheet and an outermost annulus;

the central plate being disposed above the light-holding part opposite to the lighting part so as to shade the luminescence unit;

the elongated sheet radially extending from the central plate to the outermost annulus;

the annular sheet being located in between the central plate and the outermost annulus; and the annular sheet being coupled with the plurality of elongated sheets.

17. The internal reflective light fixture of claim 16 further comprising:

the cooling shading member further comprising another annular sheet;

the another annular sheet being located in between the central plate and the outermost annulus; and the another annular sheet being coupled with the plurality of elongated sheets and separate from the annular sheet.

18. The internal reflective light fixture of claim 16 further comprising:

the elongated sheet being of a thin-slice shape.

19. The internal reflective light fixture of claim 16 further comprising:

the elongated sheet being of a thin-pole shape.

20. The internal reflective light fixture of claim 16 further comprising:

the outermost annulus being integrally from with the cup body.

* * * * *